United States Patent [19]

Cassity

[11] 3,967,460

[45] July 6, 1976

[54] APPARATUS FOR USE IN REPLACING BROKEN GUIDELINES

[75] Inventor: Thomas G. Cassity, Houston, Tex.

[73] Assignee: Cameron Iron Works, Inc., Houston, Tex.

[22] Filed: Mar. 21, 1975

[21] Appl. No.: 560,984

[52] U.S. Cl. ..... 61/72.3; 61/69 R; 114/221 A; 166/.5

[51] Int. Cl.[2] ..... F16L 1/00; E21B 7/12

[58] Field of Search ..... 166/.5, .6; 61/723, 61/721, 69; 114/221, 221 A, 206; 175/7

[56] References Cited

UNITED STATES PATENTS

| | | | |
|---|---|---|---|
| 2,249,358 | 7/1941 | Haynes | 166/54.5 |
| 3,452,815 | 7/1969 | Watkins | 166/.5 |
| 3,493,043 | 2/1970 | Watkins | 166/.5 |
| 3,709,291 | 1/1973 | Hanes et al. | 166/.5 |

*Primary Examiner*—Jacob Shapiro
*Attorney, Agent, or Firm*—W. F. Hyer; Marvin B. Eichenroht

[57] ABSTRACT

Apparatus is disclosed which permits a broken guideline which normally extends upwardly from an underwater guidepost to be cut and replaced in one trip.

14 Claims, 10 Drawing Figures

Fig. 1
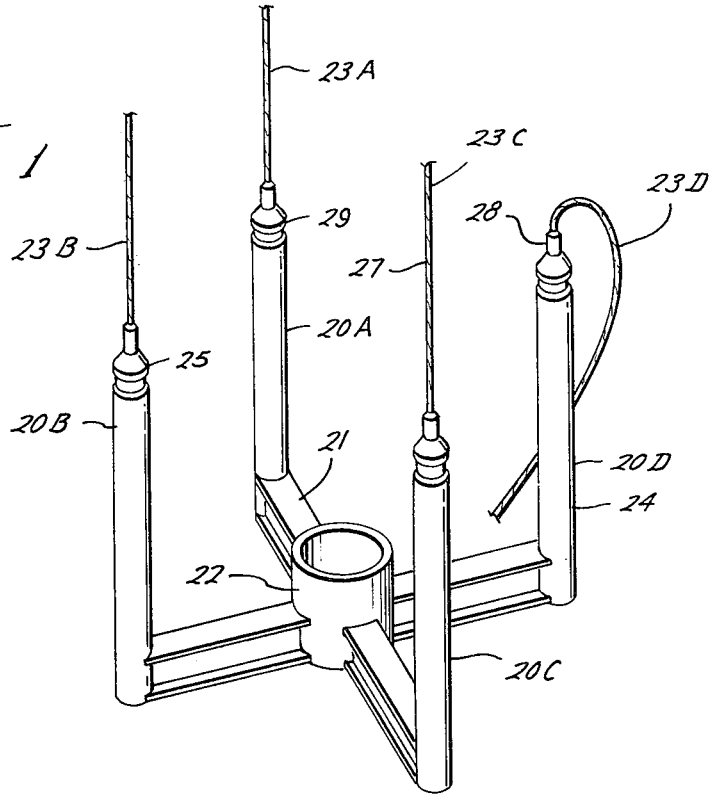
Fig. 5
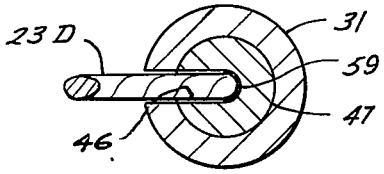
Fig. 7
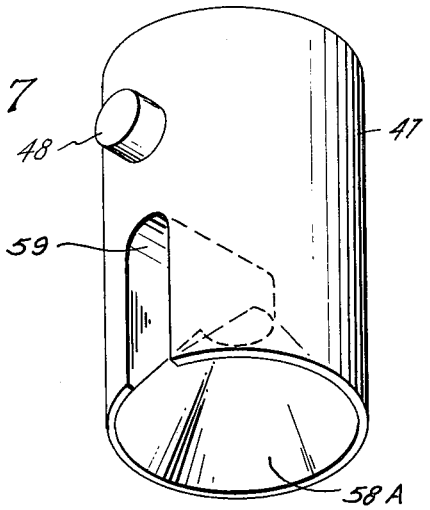
Fig. 6
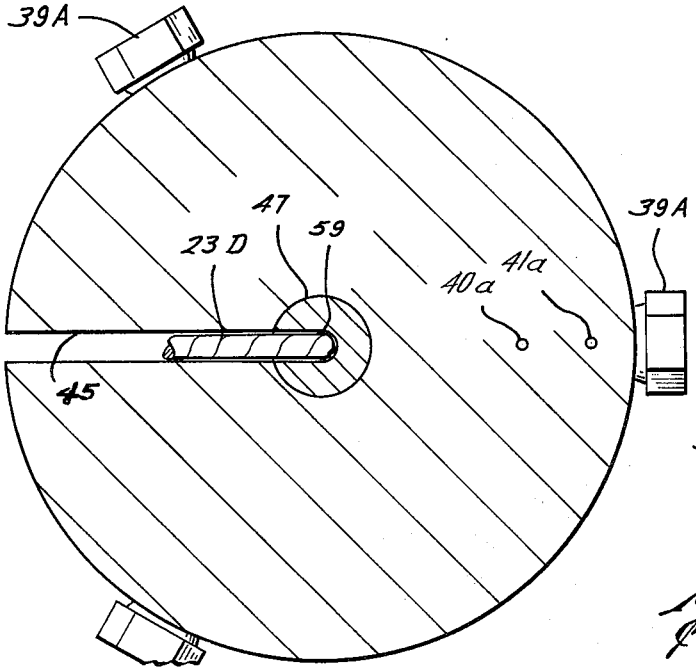
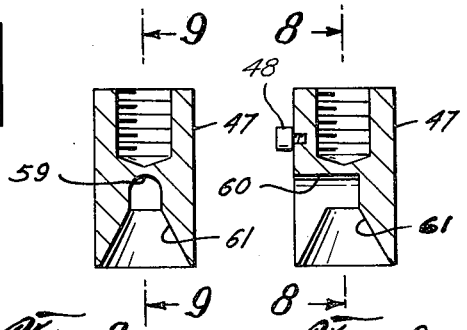
Fig. 8
Fig. 9

APPARATUS FOR USE IN REPLACING BROKEN GUIDELINES

This invention relates to improved apparatus for use in replacing broken guidelines which normally extend upwardly from underwater guideposts.

Apparatus of this type may be used to guide equipment as it is moved between an underwater oil or gas well and a drilling vessel at the water level. For this purpose, a plurality of guidelines extend from guideposts arranged in spaced-apart relation about the well, and the equipment is carried by a frame having arms which extend outwardly to support sleeves for sliding vertically along the guidelines. Funnels on the lower ends of the sleeves fit closely over correspondingly shaped upper ends of the guideposts to align the equipment with parts of the well to which it is to be connected.

The lower ends of the guidelines are firmly anchored to the guideposts so that they may be held in tension by suitable apparatus on the drilling vessel. In apparatus of this type made and sold by the assignee of the present application, the anchor is held captive beneath the lower end of a hole through the upper end of a hollow guidepost. More particularly, the anchor has spring fingers at its lower end which are urged outwardly to engage beneath the edge of the lower end of the hole, and a nose on its upper end which extends above the upper end of the guidepost. Thus, the anchor is installed in anchored position by pushing it into the hole until its spring fingers reach anchored position, and may be removed therefrom by forcing it downwardly into the hollow guidepost.

In the event one or more of the guidelines is broken, it's important that it be replaced as quickly as possible so as to minimize downtime of the drilling vessel. If the well is beneath relatively shallow water, it may be replaced by divers. However, if the water is too deep for divers, the broken guideline must be replaced by apparatus which is controllable from the drilling vessel or other remote location.

U.S. Pat. No. 3,709,291 discloses a support body on which cutting means may be carried to permit it to be lowered to the underwater level and then operated by controls on the vessel in order to cut the broken guideline near the upper end of the hole in the guidepost. Then, the support body may be raised and an adapter to which a replacement guideline is anchored is mounted on the support body to permit it to be lowered onto the upper end of the guidepost.

However, since it requires two trips of the support body to and from the wellhead, use of the above-described apparatus in repairing the guide system involves substantial downtime. Furthermore, in the event the replacement guideline is broken, a third step is involved in first removing the adapter. Still further, operation of the cutting means requires two actuators, one to locate it in position to cut the broken guideline and the other to perform the actual cutting.

An object of this invention is to provide apparatus of this type which permits the broken guideline to be cut and replaced in one trip.

Another object is to provide such apparatus in which the replacement guideline may, if broken, also be cut and replaced in one trip.

A further object is to provide such apparatus in which only a single actuator is required to operate the cutting means to cut the broken guideline.

Yet another object is to provide such apparatus in which only a single actuator is required to not only cut the broken guideline but also move its replacement into anchored position.

Still another object is to provide apparatus for cutting a broken guideline with a smooth shearing action which avoids ragged edges on the cut end of the guideline.

These and other objects are accomplished, in accordance with the illustrated embodiment of the invention, by apparatus in which a support body which is lowerable into supported position on the guidepost carries not only a cutter means, but also the lower end of a replacement guideline and a remotely controllable means for operating the cutting means to cut the broken guideline close to the guidepost and then moving the lower end of the replacement guideline into anchored position on the guidepost, the body being separable from the cutter means and replacement anchor to permit it to be raised from supported position upon anchoring of the lower end of the replacement guideline. More particularly, the body has means on it for releasably locking it to the guidepost, and the remotely controllable means comprises an actuator for guidably moving the cutter means downwardly along the body to cut the broken guideline between its cutting edge and a portion of the guidepost; and the lower end of the replacement anchor is carried on the body above the cutter means so that a single stroke of the actuator is effective to move the replacement anchor into anchored position following lowering of the cutter means to cut the broken guideline.

In the illustrated embodiment of the invention, wherein the anchor of the broken guideline is captured beneath the lower end of a hole in the upper end of a hollow guidepost, the anchor of the replacement guideline is moved into its place in the hole in the guidepost. More particularly, in its preferred embodiment, the cutting means comprises a cutting head having a cutting edge which moves downwardly within a guideway in the body which is aligned with the hole in the upper end of the guideway, so that the cutting head may move into the hole prior to its cutting edge cutting the broken guideline between it and the edge of the guidepost above the upper end of the hole. When the broken guideline is so cut, its anchor is free to be moved out of anchored position within the hole and into the hollow guidepost, whereby it may be replaced as the replacement anchor follows the cutter head into the hole in response to continued downward stroking of the actuator. As illustrated, the body and cutter head have slots which extend upwardly therein to receive the broken guideline, and the cutting edge is formed on the upper end of the slot in the cutting head.

In the drawings:

FIG. 1 is a perspective view of four guideposts arranged about an underwater well, with guidelines extending upwardly from three of them, and a broken guideline hanging downwardly to one side of the fourth;

Figure 2A:
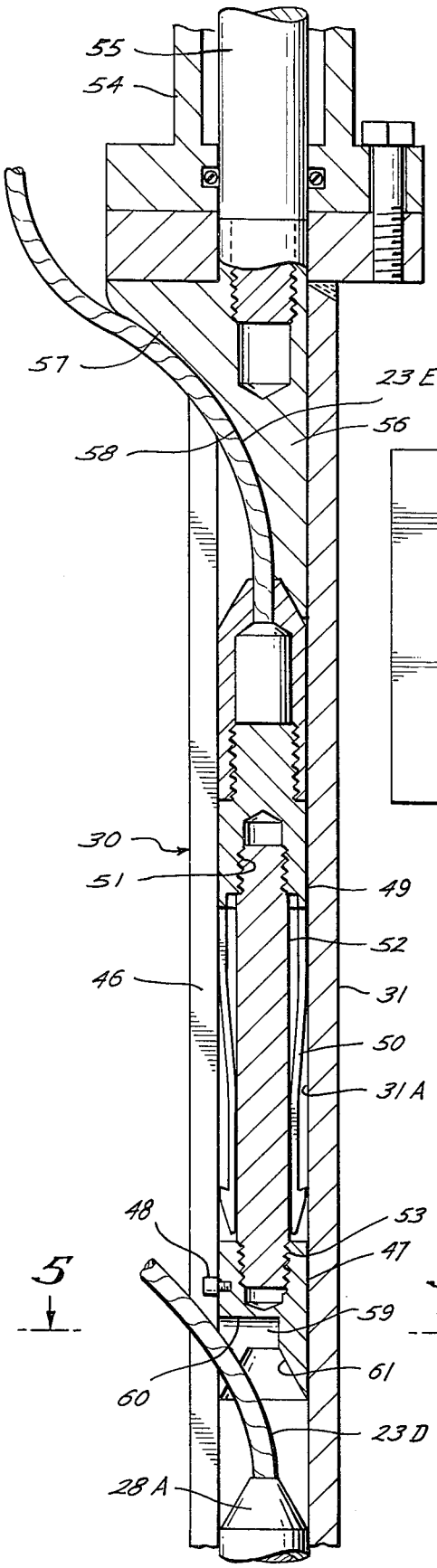
FIGS. 2A and 2B are vertical sectional views of upper and lower portions, respectively, of apparatus constructed in accordance with the present invention, and upon being lowered into the supported position on the guidepost from which the broken guideline extends.
Figure 2B:
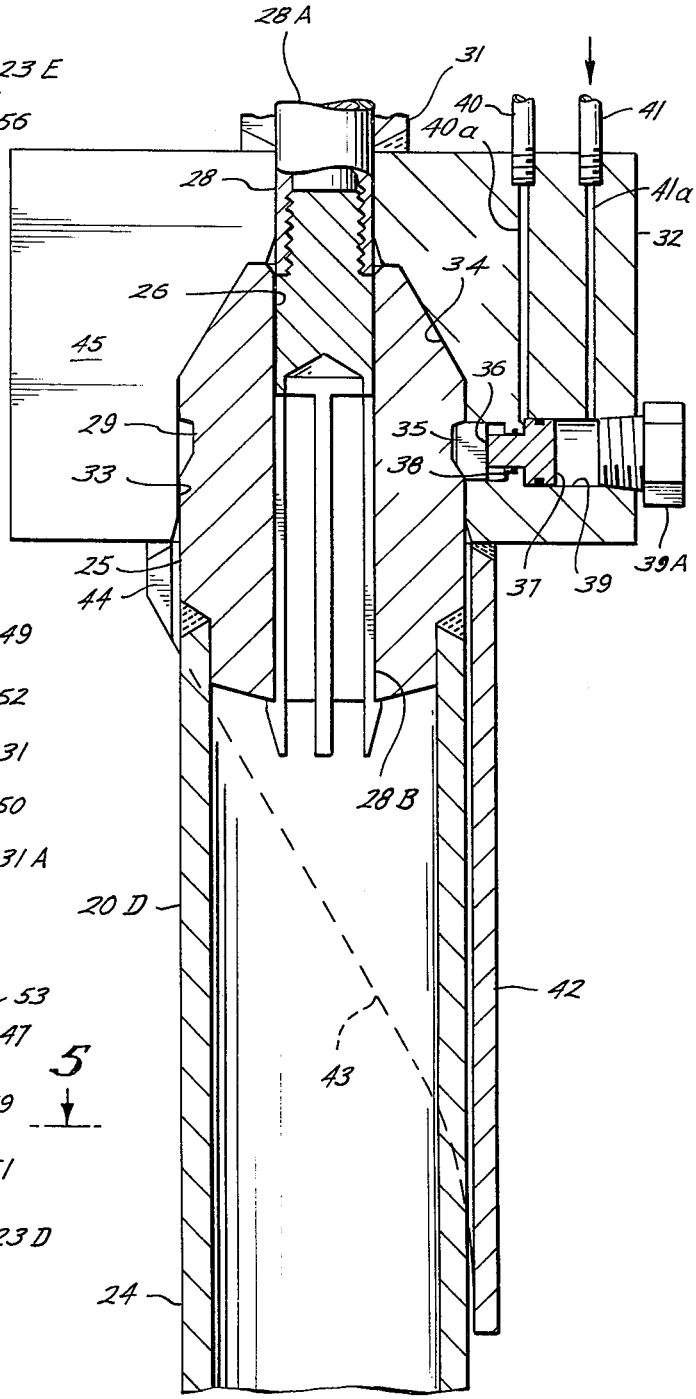
Figure 3:
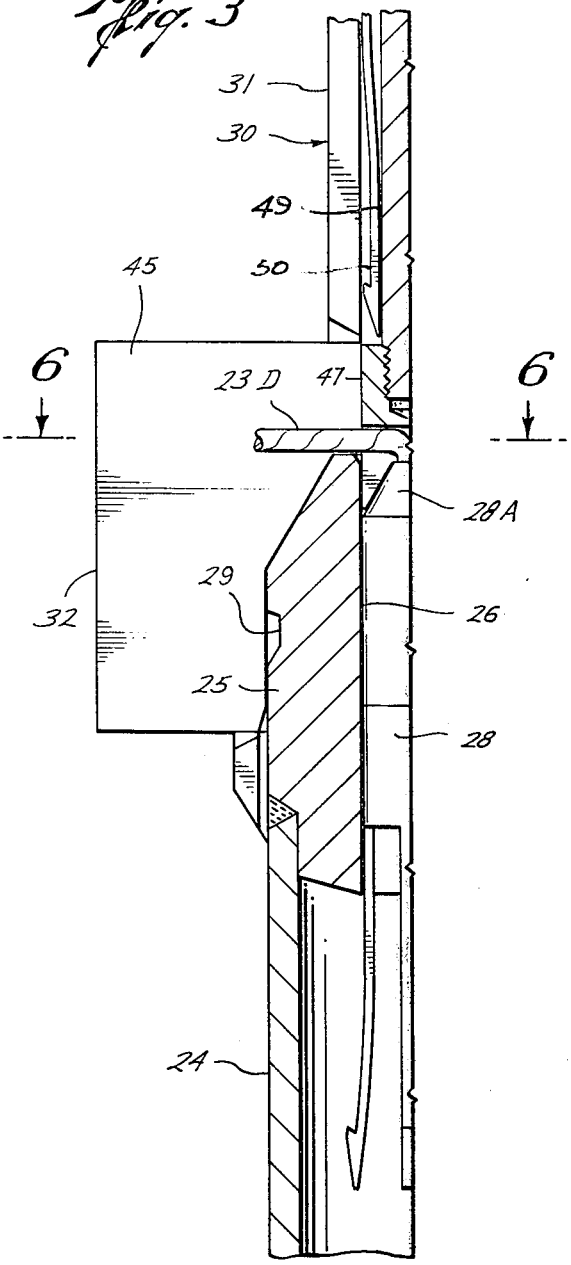
FIG. 3 is a vertical sectional view of the left half of the lower portion of the apparatus and the guidepost shown in FIGS. 2A and 2B, with the cutter head lowered into the hole in the guidepost just prior to cutting the broken guideline.
Figure 4:
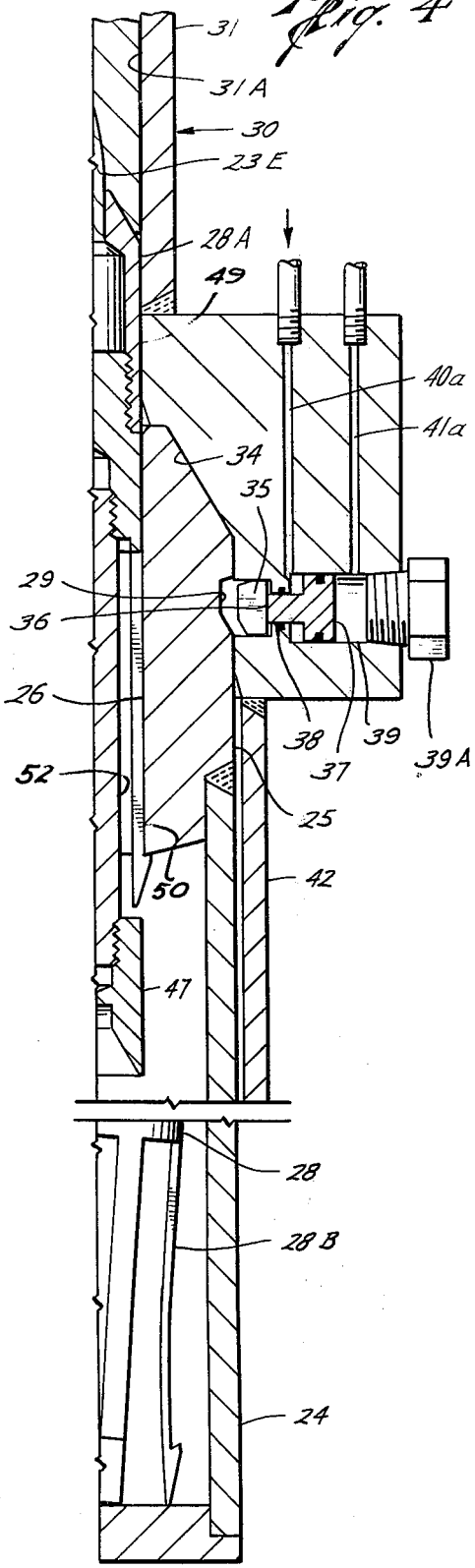

FIG. 4 is a vertical sectional view of the right half of the lower portion of the apparatus and the guidepost shown in FIGS. 2A and 2B, upon continued lowering of the cutter head and lower end of the replacement anchor within the hole in the guidepost so as to cut the broken guideline, push the anchor for the cut guideline into the hollow portion of the guidepost, and move the replacement anchor into anchored position;

FIG. 5 is a cross-sectional view of the apparatus, as seen along broken line 5—5 of FIG. 2A;

FIG. 6 is a cross-sectional view of the apparatus, as seen along broken line 6—6 of FIG. 3;

FIG. 7 is a perspective view of the cutter head, as seen from the lower end and one side thereof;

FIG. 8 is a vertical sectional view of the cutter head, as seen along broken line 8—8 of FIG. 9; and FIG. 9 is another vertical sectional view of the cutter head, as seen along broken lines 9—9 of 8.

With reference now to the details of the drawings, the four guideposts 20A, 20B, 20C and 20D are shown in FIG. 1 to be connected to the outer ends of arms 21 extending radially from a casing 22 at the upper end of an underwater well. As shown, the arms are of equal length and equally spaced apart so that the guideposts are arranged symmetrically about the axis of the well. As also shown in FIG. 1, guidelines 23A, 23B and 23C extend upwardly from the upper ends of the guideposts 20A, 20B and 20C, respectively, for connection to a drilling vessel from which drilling operations in connection with the well may be conducted. Ordinarily, a fourth guideline 23D connected to the upper end of guidepost 20D would also extend upwardly to the drilling vessel so that equipment may be guided by all four guidelines as it is lowered to or raised from the well. However, as previously described, the guideline 23D has been broken, so that, as shown in FIG. 1, it hangs downwardly to one side of the guidepost 20D.

Each of the guideposts is of identical construction, comprising, as shown in FIGS. 2B, 3 and 4 in connection with guidepost 20D, a hollow body 24 having a head 25 at its upper end which is provided with a hole 26 formed vertically through its central axis. Each guideline is also identical comprising a cable 27 having an anchor 28 at its lower end which fits closely within hole 26 through the guidepost to which it's connected, and has a nose 28A which projects above the head 25 of the guidepost when so connected. As shown in FIG. 2B in connection with guideline 23D, spring fingers 28B on the lower end of each anchor latch beneath the lower end of hole 26 in the guidepost so as to anchor it against upward movement. As previously described, the anchor may be moved into anchored position by forcing its spring fingers inwardly so that they move through the hole and downwardly to latched position.

The upper ends of both the nose of the anchor and head of the guidepost are conical to cooperate with similarly shaped funnels on the lower ends of the sleeves slidable over the guidelines. Additionally, there is a groove 29 about the upper end of each guidepost beneath the conical top surface to receive locking parts on the funnels or other parts lowered onto the guidepost during normal operations.

As will also be apparent, upon cutting of a guideline close to the upper end of the guidepost, its anchor is either free to fall or be forced downwardly through hole 26 into the hollow body 24, whereby the hole is free to receive the anchor for another guideline. As also previously described, this particular guidepost and guideline anchor construction is manufactured and sold by the assignee of the present application. However, it should be understood that the invention is applicable to other guideposts and guideline anchor constructions.

The apparatus for cutting and replacing broken guideline 23D with another guideline comprises a support body 30 having a tubular portion 31 with flange 32 on its lower end adapted to be lowered into supported position on the upper end of guidepost 20D. Thus, as shown, the flange 32 has a central hole 33 therethrough including an upper end vertically aligned with guideway 31A through the tubular portion so as to receive the nose 28A of the anchor connected to guidepost 20D, and a downwardly facing conical shoulder 34 for resting upon the upper conical end of the head 25 of the guidepost. The lower end of flange 32 fits closely about the head of the guidepost beneath its conical upper end, and latches 35 are carried within pockets 36 about the flange for movement radially between inner and outer positions engaged within (FIG. 2B) and removed from (FIG. 4) the groove 29 about the guidepost head for selectively locking the apparatus in or releasing it from supported position.

As shown, each latch 35 is adapted to be so moved by means of a piston 37 connected thereto by a rod 38 and sealably slidable within a cylinder 39 formed in flange 32 and closed at its outer end by a removable plug 39A. As will be obvious, each piston is caused to reciprocate in its cylinder, so as to move the latches between locking and unlocking positions, by means of pressure fluid alternately introduced to and exhausted from its opposite sides. For this purpose, passageways **40*a* and 41*a* in flange 32 connecting with opposite sides of one piston 37 (FIG. 2B) are in turn connected with conduits 40 and 41**, respectively, extending upwardly to a suitable pressure fluid controls, and manifolding (not shown) in the flange connects the passageways with the cylinders for the other latches.

The body also includes a skirt 42 which depends from flange 32 and has tapered sides 43 which merge at their upper ends with a slot 44 extending upwardly to the bottom side of the flange. The flange has a vertical slot 45 formed therein in vertical alignment with the slot 44, and the tubular portion of body 30 has a vertical slot 46 forming a further vertical continuation of the slots 44 and 45. Thus, as shown in FIG. 2A, when the body of the apparatus is lowered onto the guidepost 20D, broken guideline 23D will be guided by one of the tapering sides 43 of the skirt 42 through the slots 44 and 45 into the lower portion of slot 46, which is not substantially wider than the guideline itself.

The body may be guided into supported position in any number of ways, such as by connection to a frame adapted to be guided vertically along the remaining guidelines 23A, 23B, and 23C. Alternatively, the body may be guided by a single guideline, or even without any guideline, with the assistance of a television camera.

A cutter head 47 is carried within the guideway of the tubular portion of the body, with its lower end spaced above the nose 28A of the anchor of the broken guideline, and an anchor 49 connected to the lower end of a replacement guideline 23E is also carried within the guideway of the body above the cutter head. The spring fingers 50 of the replacement anchor are spaced a fixed distance above the cutter head 47 by means of a rod 52 threadedly connected at 51 to the lower end of the nose of the replacement anchor and at 53 to the upper end of the cutter head. The cutter head and replacement anchor are held in the vertical positions shown in FIG. 2A by the replacement guideline 23E which is tied in any suitable manner to either body 30 or the equipment on which it is lowered.

An actuator carried by the body includes a cylinder 54 mounted on the upper end of tubular portion 31, and a piston (not shown) vertically reciprocal in the cylinder and having a rod 55 which extends downwardly through the lower end of the cylinder and into guideway 31A of the tubular portion 31. The lower end of the rod is connected to a pusher 56 having a lower end which is guided within the guideway of the tubular housing above the nose of the replacement anchor, and a side flange 57 which extends through the slot 46 so as to prevent the pusher from rotating. A curved surface 58 on the side of the pusher diverts the lower end of the replacement guideline 23E through slot 46. The lower end of the pusher engages the nose of the replacement anchor so as to be in position to lower the anchor and thus the cutter head upon a downward stroke of the piston rod. As will be understood, the rod may be so lowered by fluid pressure introduced into the cylinder above the piston, as by means of suitable remote controls.

The lower end of the cutting head has a conical surface 58A formed therein for fitting closely over the upper conical surface of the nose 28A of the anchor to be replaced. The lower end of the cutter head 47 is also provided with a slot 59 which intersects the lower conical surface, as best shown in FIGS. 7 to 9, and this slot is held aligned with the slot 46 in the tubular portion of body 30 by means of a pin 48 slidable within the slot. The edge of the semi-circular upper end 60 of the slot forms a cutting edge which is located just above broken guideline 23D.

Following lowering of the body into supported position, and anchoring thereof to the guidepost, the actuator is operated to move the pusher 56 downwardly. As the pusher is moved downwardly against replacement guideline 49, the cutter head 47 is moved downwardly to engage the conically shaped nose 28A on the anchor to be replaced, the guideline 23D being received within slot 59. Upon continued downward movement of the piston of the actuator, the anchor of the replacement guideline is pushed downwardly through the lower end of guideway 31A and into a lower position within hole 26. At the same time, the cutter head follows the upper end of the anchor to be replaced downwardly within the hole 26.

As shown in FIG. 3, as the cutter head moves further into hole 26, the broken guideline 23D will be squeezed and cut between its cutting edge and the vertically aligned edge of the upper end of the guidepost about the upper end of hole 26. It will be understood in this regard that the movement of the lower end of the cutter head into the hole will prevent its cutting edge from being spread outwardly as it cuts across the broken guideline, thereby insuring a clean cut. The anchor to be replaced is thus free to move out of the hole into the hollow body of the guidepost beneath it. This may occur immediately following cutting of the guideline, or following further downward movement of the piston following the cutting operation, depending on the tightness of the fit of the anchor within the hole.

As the anchor 28 is forced out of the hole, the replacement anchor 49 is moved downwardly into the hole to take its place. Thus, since the hole forms a vertical continuation of the guideway through the body, the spring fingers 50 of the replacement anchor are held in retracted position as they move downwardly through the hole, until they reach a level at which their lower ends are free to spring outwardly beneath the lower end of the hole, as shown in FIG. 4. At this time, the replacement anchor, as well as the replacement guideline 23E extending upwardly from its upper end and through the slot 46 in the tubular portion of the body beneath the curved surface 58, are in anchored position.

As will be understood from the foregoing description, the body 30 is separate from the replacement anchor so that it may be raised and returned to water level. For this purpose, latches 35 may be retracted to release the body from the guidepost, and the body then raised by means of the same equipment used to lower it. Upon raising of the body, the replacement guideline 23 may be pulled upwardly to upright position for cooperation with the other guidelines 23A, 23B and 23C.

It will be understood from the foregoing that since the upper end of the replacement anchor is identical to the replaced anchor, it is possible in the event the replacement guideline 23E is broken, to replace it in the same manner that the broken guideline 23D was replaced.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The Invention having been described, what is claimed is:

1. Apparatus for use in replacing a broken guideline which is anchored at its lower end to an underwater guidepost, comprising a body lowerable into supported position on the guidepost, cutting means carried on the body, a replacement guideline having its lower end carried on the body, and remotely controllable means carried by the body for operating the cutting means to cut the broken guideline close to the guidepost and for moving the lower end of the replacement guideline into anchored position on said guidepost, said body being separable from the cutting means and the replacement guideline to permit it to be raised from supported position upon anchoring of the lower end of the replacement guideline.

2. Apparatus of the character defined in claim 1, wherein the body has means thereon for releasably locking said body to the guidepost, and the cutting means is guidably mounted on the body for movement into a position to cut the broken guideline between it and a portion of the guidepost.

3. Apparatus of the character defined in claim 2, wherein the lower end of the replacement guideline is guidably mounted on the body above the cutter means, and said remotely controllable means comprises an actuator which is carried by the body above the lower end of the replacement guideline in position to sequentially lower the cutting means to cut the broken guideline and then move the lower end of the replacement guideline into anchored position.

4. Apparatus for use in replacing a broken guideline which has an anchor captured beneath the lower end of a hole in the upper end of an underwater guidepost, comprising a body lowerable into supported position on the guidepost, cutting means carried by the body, a replacement guideline having an anchor carried on the body, and remotely controllable means carried by the body for operating the cutting means to cut the broken guideline close to the upper end of the hole and for moving the anchor of the replacement guideline into the hole in the upper end of said guidepost so as to anchor said replacement guideline thereto, upon movement of the broken guideline out of anchored position, said body being separable from the cutting means and replacement anchor to permit it to be raised from supported position upon anchoring of the lower end of the replacement guideline.

5. Apparatus of the character defined in claim 4, wherein the body has means thereon for releasably locking said body to the guidepost, and the cutting means is guidably mounted on the body for movement into a position to cut the broken guideline between said cutter head and a portion of the guidepost.

6. Apparatus of the character defined in claim 5, wherein the replacement anchor is guidably mounted on the body above the cutter means, and said remotely controllable means comprises an actuator which is carried by the body above the replacement anchor in position to sequentially lower the cutting means to cut the broken guideline and then move the replacement anchor through said hole during a downward stroke.

7. Apparatus for use in replacing a broken guideline which has an anchor removably anchored within a hole in the upper end of a hollow underwater guidepost, comprising a body lowerable into supported position over the upper end of the guidepost, means for releasably locking the body to the guidepost in its supported position thereon, said body having a vertical guideway therein which is aligned with the hole in the guidepost when the body is supported thereon, a cutting head having a cutting edge carried on the body for movement downwardly within the guideway and into the hole so as to cut the broken guideline between said cutting edge and the edge of the guidepost about the upper end of the hole and force the anchor of the broken guideline out of anchored position within said hole and into the hollow guidepost, and remotely controllable means carried by the body for so moving the cutting head, and then removing the cutting head from within said hole so that an anchor for a replacement guideline may be moved into removably anchored position within said hole.

8. Apparatus of the character defined in claim 7, wherein the body and cutting head have slots extending upwardly therein to receive the broken guideline, and the cutting edge is formed on the upper edge of the slot in the cutting head.

9. Apparatus of the character defined in claim 8, wherein the upper end of anchor extends above upper end of hole, and the lower end of the body guideway fits closely over said upper end of the anchor.

10.Apparatus of the character defined in claim 8, wherein said body has inclined surfaces on its lower end for guiding the broken guideline into the slot in said body.

11. Apparatus for use in replacing a broken guideline which has an anchor removably anchored within a hole in the upper end of a hollow underwater guidepost, comprising a body lowerable into supported position over the upper end of the guidepost, means for releasably locking the body to the guidepost in its supported position thereon, said body having a vertical guideway therein which is aligned with the hole in the guidepost when the body is supported thereon, a cutting head having a cutting edge carried on the body for movement downwardly within the guideway and into the hole so as to cut the broken guideline between said cutting edge and the edge of the guidepost about the upper end of the hole, and to force the anchor of the broken guideline out of anchored position within said hole and into the hollow guidepost, a replacement guideline having an anchor carried on the body above the cutter head for movement downwardly within the guideway and into said hole, so that the replacement anchor may be moved into anchored position, and remotely controllable means carried by the body for so moving the cutting head and replacement anchor, said body being separable from the cutter head and replacement anchor to permit it to be raised from supported position.

12. Apparatus of the character defined in claim 11, wherein the body and cutting head have slots extending upwardly therein to receive the broken guideline, and the cutting edge is formed on the upper edge of the slot in the cutting head.

13. Apparatus of the character defined in claim 12, wherein the upper end of the anchor extends above the upper end of the hole, and the lower end of the body guideway fits closely over said lower end of the anchor.

14. Apparatus of the character defined in claim 12, wherein said body has inclined surfaces on its lower end for guiding the broken guideline into the slot in said body.

* * * * *